United States Patent [19]

Wayman

[11] Patent Number: 4,972,230

[45] Date of Patent: Nov. 20, 1990

[54] TONER USAGE DETECTOR BASED ON CURRENT BIASING MIXING MEANS

[75] Inventor: William H. Wayman, Ontario, N.Y.

[73] Assignee: Xerox Corporation, Stamford, Conn.

[21] Appl. No.: 429,745

[22] Filed: Oct. 31, 1989

[51] Int. Cl.[5] ..... G03G 21/00

[52] U.S. Cl. ..... 355/246; 355/259

[58] Field of Search ..... 355/245, 246, 251, 259, 355/214; 118/658, 653, 656, 657

[56] References Cited

U.S. PATENT DOCUMENTS

| | | | |
|---|---|---|---|
| 3,821,938 | 7/1974 | Bacon et al. | 118/7 |
| 3,932,034 | 1/1976 | Takahashi | 355/3 DD |
| 4,064,834 | 12/1977 | Sund | 118/646 |
| 4,270,487 | 6/1981 | Terashima et al. | 118/690 |
| 4,338,019 | 7/1982 | Terashima et al. | 355/14 D |
| 4,343,548 | 8/1982 | Bares et al. | 355/3 DD |
| 4,508,052 | 4/1985 | Kohyama | 118/658 X |
| 4,643,561 | 2/1987 | Folkins | 355/14 D |
| 4,669,852 | 6/1987 | Tajima et al. | 118/653 X |
| 4,686,934 | 8/1987 | Kohyama | 118/656 X |
| 4,786,869 | 11/1988 | Kanai et al. | 324/207 |

FOREIGN PATENT DOCUMENTS

| | | | |
|---|---|---|---|
| 0235872 | 10/1986 | Japan | 355/246 |
| 0180983 | 7/1988 | Japan | 355/246 |

*Primary Examiner*—A. T. Grimley
*Assistant Examiner*—William J. Royer
*Attorney, Agent, or Firm*—H. Fleischer; J. E. Beck; R. Zibelli

[57] ABSTRACT

An apparatus which measures the usage of toner in a developer unit. A donor roll receives toner material from a mixer. The mixer fluidizes the toner with the pressure from newly discharged toner moving the fluidized toner from one end of the developer unit to the other end thereof. An electrical bias is applied between the donor roll and mixer. The current biasing the mixer is detected and a signal transmitted in response thereto corresponding to the usage of toner in the developer unit. This signal controls the discharge of toner into the developer unit.

20 Claims, 4 Drawing Sheets

TONER USAGE DETECTOR BASED ON CURRENT BIASING MIXING MEANS

This invention relates generally to an electrophotographic printing machine, and more particularly concerns an apparatus for measuring the usage of toner in a developer unit.

In an electrophotographic printing machine, a photoconductive member is charged to a substantially uniformed potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material onto contact therewith. This forms a powder image on the photoconductive member which is subsequently transferred to a copy sheet. The copy sheet is heated to permanently affix the marking particles thereto in image configuration.

In the foregoing type of printing machine, a development system is employed to deposit developer material onto the electrostatic latent image recorded on the photoconductive surface. Generally, the developer material has toner particles adhering triboelectrically to coarser carrier granules. Typically, the toner particles are made from a thermoplastic material while the carrier granules are made from a ferromagnetic material. Alternatively, a single component magnetic material may be employed. A continuous supply of toner particles must be available to be capable of copying large numbers of original documents or producing multiple copies of the same original document. This is necessary in order to insure that the machine is not shut down at relatively short intervals due to the lack of toner particles. This is achieved by storing a supply of toner particles in a toner container and dispensing additional toner particles into one end of the developer housing chamber. The toner particles are then transported across the chamber of the developer housing and advanced to a developer roller. The developer roller transports the toner particles closely adjacent to the photoconductive member and the latent image attracts toner particles thereto. However, it has been found that it is frequently difficult to determine when it is necessary to furnish additional toner to the developer unit. This has resulted in image defects which degrade the quality of the copy. Various approaches have been devised for controlling the dispensing of toner particles into a developer unit. The following disclosures appear to be relevant:

U.S.-A-3,821,938; Patentee: Bacon et al.; Issued: July 2, 1974.

U.S.-A-3,932,034; Patentee: Takahashi; Issued: Jan. 13, 1976.

U.S.-A-4,064,834; Patentee: Sund; Issued: Dec. 27, 1977.

U.S.-A-4,270,487; Patentee: Terashiima et al.; Issued: June 2, 1981.

U.S.-A-4,338,019; Patentee: Terashiima et al.; Issued: July 6, 1982.

U.S.-A-4,343,438; Patentee: Bares et al.; Issued: Aug. 10, 1982.

U.S.-A-4,643,561; Patentee: Folkins; Issued: Feb. 17, 1987.

U.S.-A-4,786,869; Patentee: Kanai et al.; Issued: Nov. 22, 1988.

The relevant portions of the foregoing patents may be briefly summarized as follows:

U.S.-A-3,821,938 discloses a developer station electrically isolated from the remainder of a reproduction apparatus and the photoreceptor. The developer station is connected to ground. As charge is removed from the developer material with the removal of triboelectrically charged toner, an equal charge returns to the developer material through the developer station and ground lead. The current in the ground lead is representative of the time rate of charge removal from the developer material. This current is integrated by an operational amplifier to obtain a total charge signal which is used to control dispensing of toner particles into the developer material.

U.S.-A-3,932,034 describes a detector for sensing the dielectric breakdown voltage of the developer material used in a printing machine. An electrode is positioned adjacent a magnetic brush roller in contact with the developer material. A circuit is connected to the electrode and the dielectric breakdown voltage of the developer material determined. Whenever the concentration of developer is reduced, a current flows as a result of the dielectric breakdown voltage. This current is detected and produces a detection signal which operates a control circuit to discharge additional toner.

U.S.-A-4,064,834 discloses a cross mixer assembly electrically isolated from the developer housing by an insulating layer. The cross mixer assembly is made from a a conductive metal which is triboelectrically dissimilar from the developer mix employed in the developer assembly. The movement of the developer mix over the surface of the cross mixer produces a making and breaking of contact therebetween to generate a current flow in the cross mixer. This current passes through a resistor and the voltage across the resistor is detected and used to control replenishment of toner to the developer mix as the toner concentration decreases.

U.S.-A-4,270,487 describes a developer level sensor installed on the side wall of a developer container which consists of an oscillator circuit with multiple coils. Magnetism of the developer acts intensely on an electric coil and the oscillating condition of the oscillation circuit is established. When the level of the developer lowers, the magnetism acting on the electric coil decreases and the oscillation stops. This turns on a current flow through a solenoid which opens a supplementary feed valve to replenish toner.

U.S.-A-4,338,019 discloses an electrically conductive plate which removes developer material from the peripheral surface of the sleeve of a developer roll and picks up current corresponding to the charge on the toner so that the current may be grounded and discharged by a conductor and a high resistance resistor. The voltage across the resistor is measured and used in conjunction with a control circuit for regulating a motor which drives the sleeve. The angular rotation of the sleeve increases as the concentration of toner in the developer material decreases.

U.S.-A-4,343,548 describes a probe electrically connected to a controller which is electrically connected to a toner dispenser motor. The probe contacts the developer material on a developer roller and senses the electrical current flowing through the developer material.

The controller, as a function of the signal from the probe, actuates the motor to discharge additional toner into the developer housing.

U.S.-A-4,643,561 discloses a charging roll and a developer roller. The charging roll charges the toner and contacts the developer roll. The developer roll and charging roll are electrical biased. The electrical bias currents are summed and used to control various processing stations within the printing machine.

U.S.-A-4,786,869 describes a toner level sensor using a pair of transformers having primary coils and secondary coils such that the differential output of the secondary coil is phase detected to determine the presence or absence of residual toner.

Pursuant to the features of the present invention, there is provided an apparatus for measuring the usage of toner in a developer unit. The apparatus includes means for developing a latent image with toner. Means are provided for mixing the toner in the developer unit. Means apply an electrical bias between the mixing means and the developing means so that toner is attracted to the developing means. Means detect the current biasing the mixing means and transmit a signal in response thereto corresponding to the usage of toner in the developer unit.

In accordance with another aspect of the present invention, there is provided an electrophotographic printing machine of the type having an electrostatic latent image recorded on a photoconductive member. The improvement includes means for developing the electrostatic latent image with toner. Means mix the toner in the developer unit. Means are provided for applying an electrical bias between the mixing means and the developing means so that developer material is attracted to the developing means. Means detect the current biasing the mixing means and transmit a signal in response thereto corresponding to the usage of toner in the developer unit.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
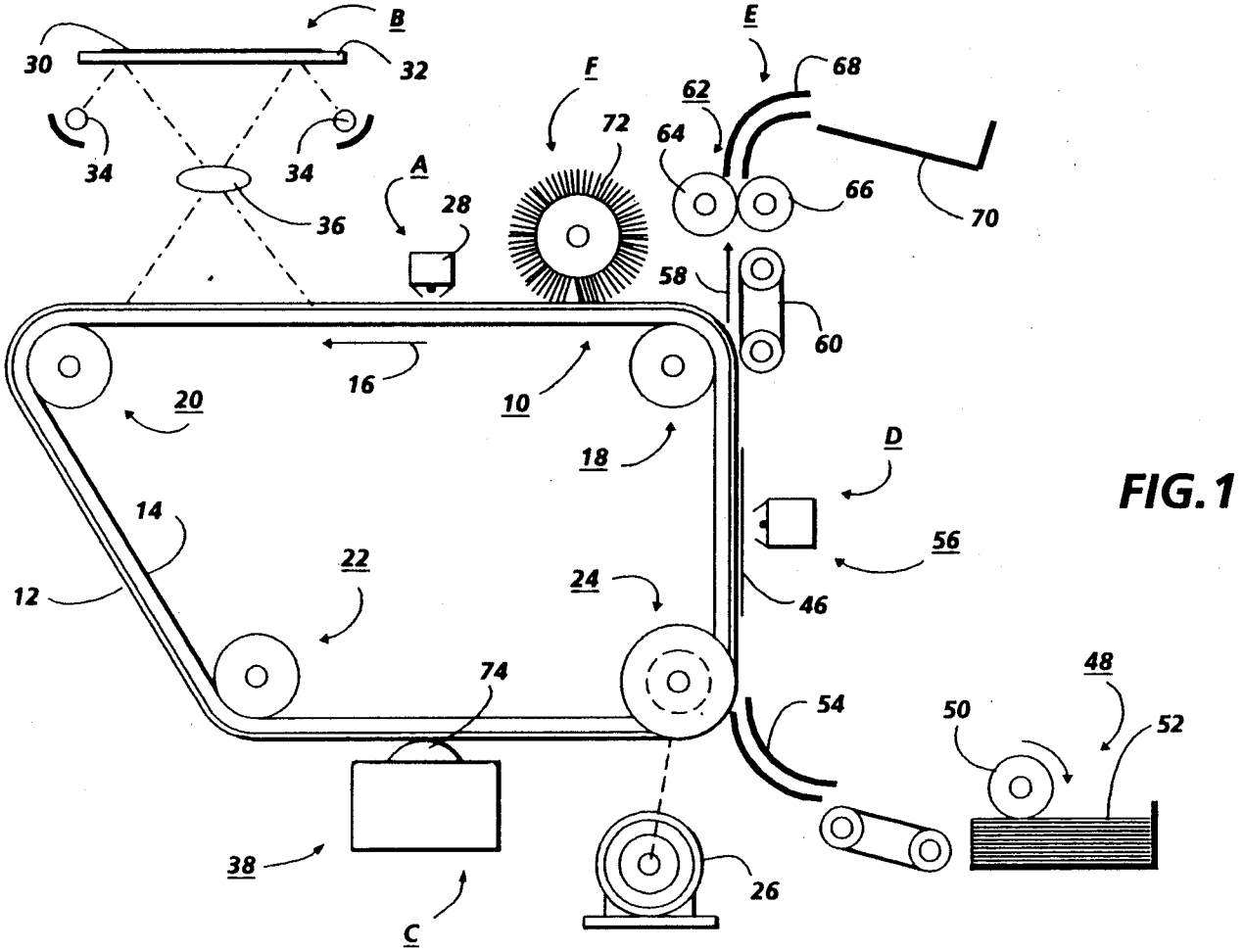
FIG. 1 is a schematic elevational view depicting an electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the apparatus of the present invention therein. It will become evident from the the following discussion that this apparatus is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

At development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 2.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 2:
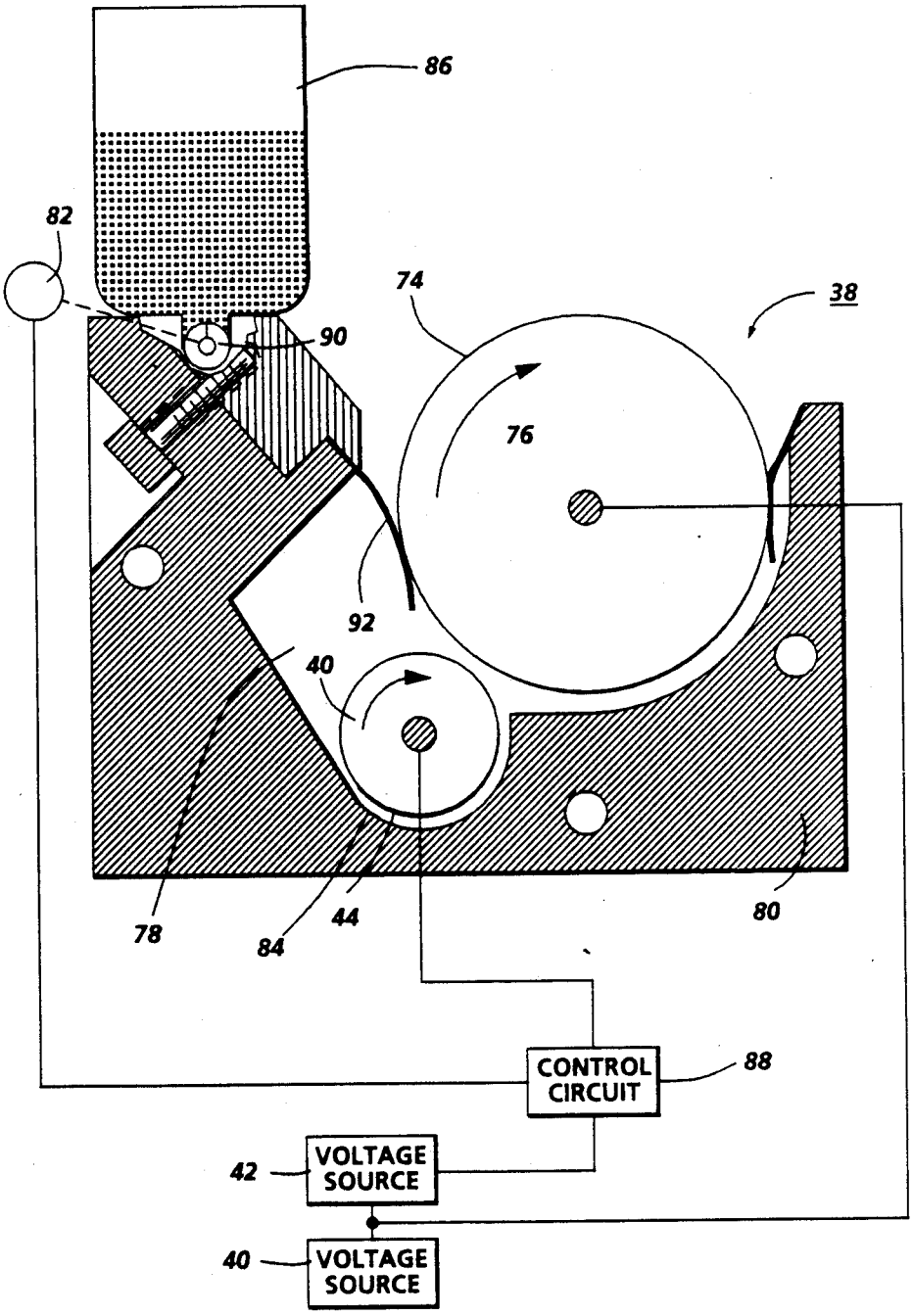
FIG. 2 is a schematic elevational view showing the development apparatus used in the FIG. 1 printing machine.

Referring now to FIG. 2, the detailed structure of developer unit 38 is shown thereat. The developer unit include a donor roller 74. Donor roller 74 may be a bare metal such as aluminum. Alternatively, the donor roller may be a metal roller coated with a material. For example, a polytetrafluoroethylene based resin such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon. The surface of the donor roller is roughened from a fraction of a micron to several microns, peak to peak. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor which rotates donor roller 74 in the direction of arrow 76. Donor roller 74 is positioned, at least partially, in chamber 78 of housing 80. A toner mixer, indicated generally by the reference numeral 44, mixes and fluidizes the toner particles. The fluidized toner particles seek their own level under the influence of the gravity. Inasmuch as new toner particles are being discharged from container 86 into one end of the chamber 78 of housing 80, the force exerted on the fluidized toner particles by the new toner particles being added at that end moves the fluidized toner particles from that end of housing 80 to the other end thereof. Toner mixer 44 is an elongated member located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are discharged into one end of chamber 78 from container 86. As elongated member 44 rotates in the direction of arrow 40, toner particles are mixed and fluidized. The force exerted on the fluidized toner particles by the new particles being discharged into chamber 78 advances the fluidized toner particles from the end of the chamber in which the new toner particles have been discharged to the other end thereof. The detailed manner of operation of toner mixer and fluidizer 44 is described in co-pending U.S. patent application Ser. No. 07/428726 filed in the name of Brewington and Wayman in 1989, the relevant portions thereof being hereby incorporated into the present application. The fluidized toner particles being moved are attracted to donor roller 74. Voltage source 42 is electrically connected to elongated member 44 by control circuit 88. Voltage source 40 is connected to voltage source 42 and donor roll 74. Voltage sources 40 and 42 are DC voltage sources. This establishes an electrical bias between donor roll 74 and toner mixer 44 which ranges from about 250 volts to about 1000 volts. Preferably, an electrical bias of about 600 volts is applied between donor roller 74 and toner mixer 44. The current biasing the toner mixer is a measure of toner usage. Control circuit 88 detects the current biasing the toner mixer 44 and, in response thereto, generates a control signal. The control signal from control circuit 88 regulates the energization of motor 82. Motor 82 is connected to auger 90 located in the open end of container 86. As auger 90 rotates, it discharges toner from container 86 into chamber 78 of housing 80. Toner mixer 44 is spaced from donor roller 74 to define a gap therebetween. This gap may range from about 0.05 centimeters to about 0.15 centimeters. Donor roller 74 rotates in the direction of arrow 76 to move the toner particles attracted thereto into contact with the electrostatic latent image recorded on photoconductive surface 12 of belt 10. As donor roller 74 rotates in the direction of arrow 76, charging blade 92 has the region of the free end thereof resiliently urged into contact with donor roller 74. Charging blade 92 may be made from a metal, silicone rubber, or a plastic material. By way of example, charging blade 92 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particle layer adhering to donor roller 74 is charged to a maximum of 60 microcoulombs/gram with the toner mass adhering thereto ranging from about 0.1 milligrams per centimeter$^2$ to about 2 milligrams per centimeter$^2$ of roll surface.

Figure 3:
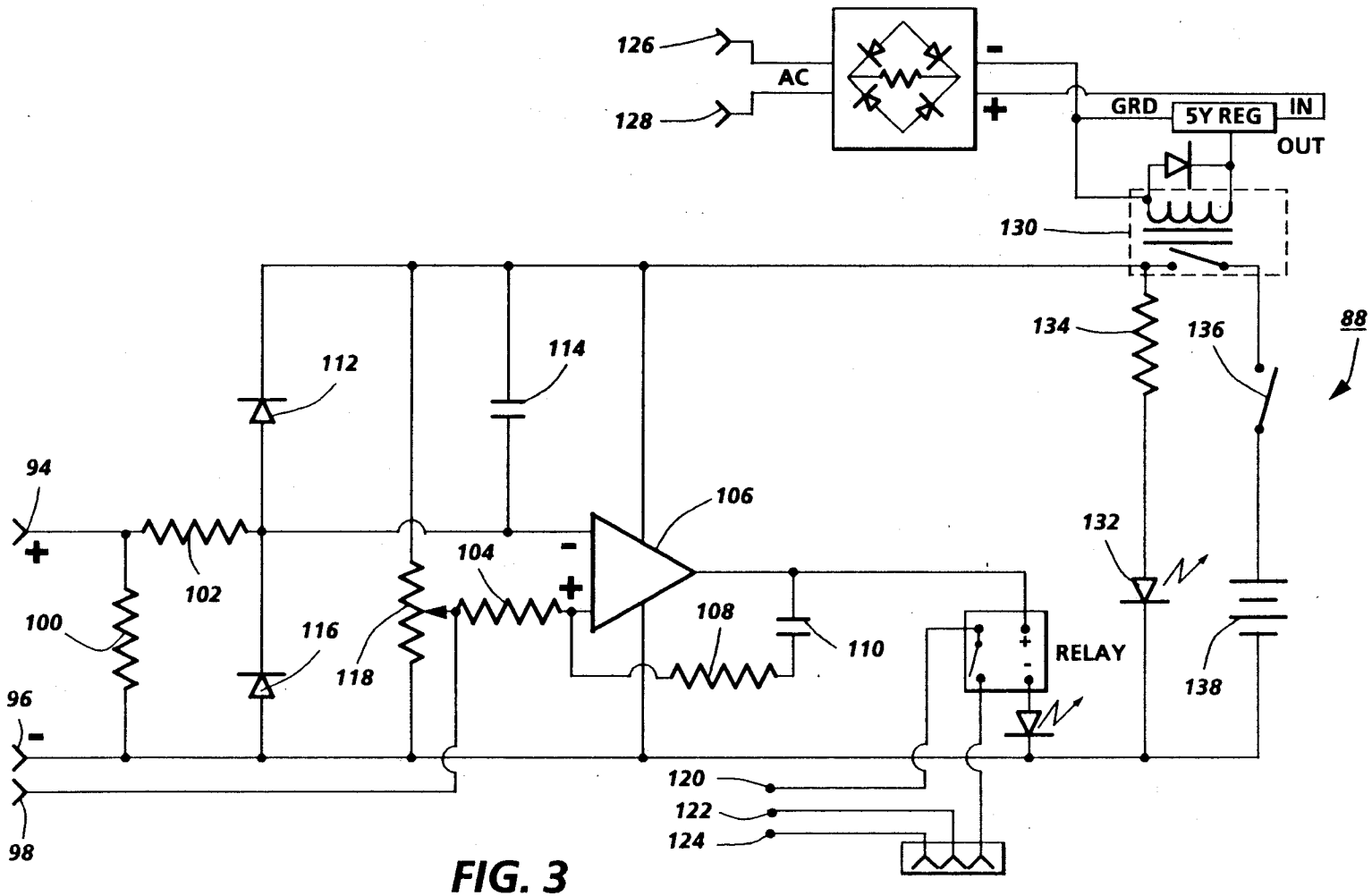
FIG. 3 is a circuit diagram of the control circuit used in the FIG. 2 development apparatus.

Turning now to FIG. 3, there is shown the details of control circuit 88. As shown thereat, terminals 94 and 96 are connected between voltage source 42 and toner mixer 44. A 1M ohm resistor 100 is connected across terminals 94 and 96 so that the toner mixer current is detected by circuit 88. A 100K ohm resistor 102 is connected to resistor 100 and terminal 94. Terminal 98 is a set point reference and connected to resistor 104 which is the positive input to amplifier 106. A 1M ohm resistor 108 and a 0.5 micro farad capacitor 110 are connected across amplifier 106 between the input and output thereof. A diode 112 and a 0.1 micro farad capacitor 114 are connected to amplifier 106. Diode 112 is also connected to resistor 102 and diode 116. Diode 116 is connected in parallel with resistors 100 and 102. A 50K ohm resistor 118 is connected in parallel with diodes 112 and 116. Terminal 98 is also connected to resistor 118. Terminals 120, 122 and 124 are connected to motor 82. Terminals 126 and 128 are connected to relay 130 to control the motor rotating toner mixer 44. Diode 132 and a 680 ohm resistor 134 are connected in series and in parallel with resistor 118. An operator actuatable switch 136 and a nine volt DC voltage source 138 are connected in series and in parallel with resistor 134 and diode 132.

Figure 4:
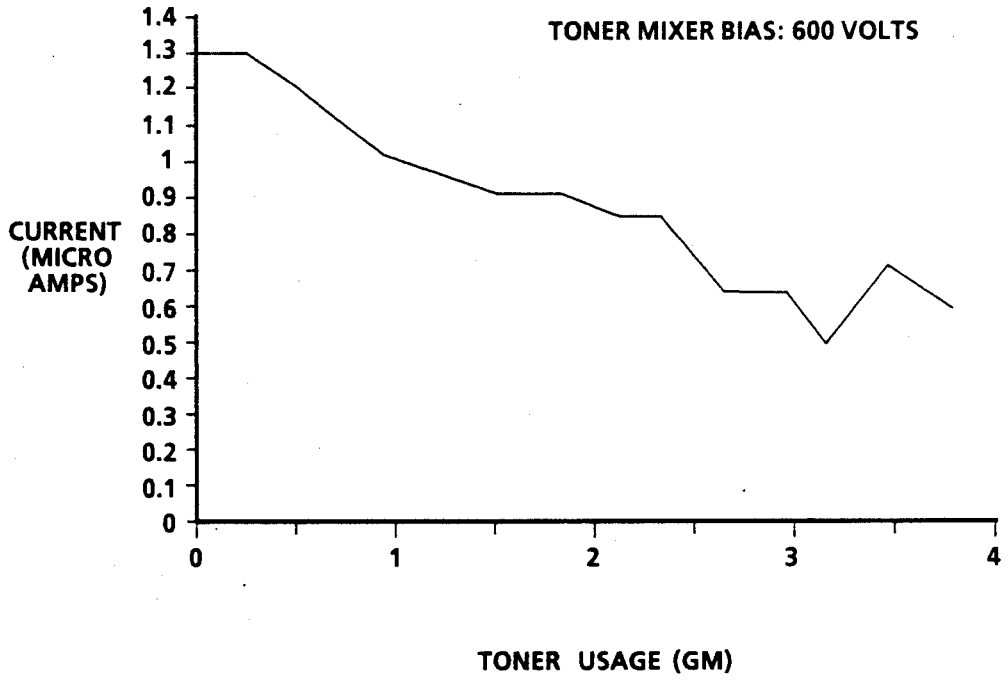
FIG. 4 is a graph showing the change in current as a function of the mass of toner removed from the developer unit.

Referring to FIG. 4, there is shown a graph of the mass of toner removed from chamber 78 of housing 80 and the resultant decrease in measured current biasing toner mixer 44. With no toner removed from the chamber of the housing, the bias current, when the voltage between donor roll 74 and toner mixer 44 is set at 600 volts, is 1.3 micro amps. This current decreases to about 0.5 micro amps when toner usage has increased to about 3.8 grams. As the quantity of toner particles in chamber 78 decreases, the measured current also decreases. It is evident from FIG. 4 that the relationship between the bias current and toner usage is approximately linear.

In recapitulation, it is clear that the apparatus of the present invention includes an electrically biased toner mixer disposed in the chamber of the developer housing for mixing and fluidizing the toner particles therein. An electrical bias is applied between a donor roller and the toner mixer. Fluidized toner particles are attracted from the toner mixer to the donor member. The donor member transports the fluidized toner particles closely adjacent to the photoconductive belt so as to develop the electrostatic latent image recorded thereon. The biasing current is measured to provide a signal indicative of toner usage. This toner usage signal controls dispensing of toner particles into the chamber of the developing housing.

It is, therefore, evident that there has been provided, in accordance with the present invention an apparatus for measuring toner usage that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for measuring the usage of toner in a developer unit, including:

means for developing a latent image with toner;

means for mixing the toner in the developer unit;

means for applying an electrical bias between said mixing means and said developing means so that toner is attracted to said developing means; and means for detecting the current biasing said mixing means and transmitting a signal in response thereto corresponding to the usage of toner in the developer unit.

2. An apparatus according to claim 1, further including means, responsive to the signal from said detecting means, for discharging additional toner into the developer unit.

3. An apparatus according to claim 2, further including means for electrically charging the toner being advanced into contact with the latent image by said developing means.

4. An apparatus according to claim 3, wherein said charging means meters the quantity of toner being advanced by said developing means to the latent image.

5. An apparatus according to claim 4, wherein said developing means includes a donor roller.

6. An apparatus according to claim 5, wherein said charging means includes a blade having the free end region thereof resiliently urged into engagement with said donor roller.

7. An apparatus according to claim 6, wherein said mixing means includes a rotatably mounted elongated member disposed interiorly of the developer unit for fluidizing the toner with the toner being discharged into the developer unit exerting a pressure on the fluidized toner to move the fluidized toner from one end of the developer unit to the other end thereof.

8. An apparatus according to claim 7, wherein said applying means includes a voltage source electrically coupled to said elongated member and said donor roll to apply an electrically bias between said elongated member and said donor roll.

9. An apparatus according to claim 8, wherein said voltage source applies an electrical bias ranging from about 250 volts to about 1000 volts between said elongated member and said donor roll.

10. An apparatus according to claim 9, wherein said voltage source applies an electrical bias preferably of about 600 volts between said elongated member and said donor roll.

11. An electrophotographic printing machine of the type having an electrostatic latent image recorded on a photoconductive member and a developer unit, wherein the improvement includes:

means for developing the electrostatic latent image with toner;

means for mixing the toner in the developer unit;

means for applying an electrical bias between said mixing means and said developing means so that toner is attracted to said developing means; and means for detecting the current biasing said mixing means and transmitting a signal in response thereto corresponding to the usage of toner in the developer unit.

12. A printing machine according to claim 11, further including means, responsive to the signal from said detecting means, for discharging additional toner into the developer unit.

13. A printing machine according to claim 12, further including means for electrically charging the toner being advanced into contact with the electrostatic latent image by said developing means.

14. A printing machine according to claim 13, wherein said charging means meters the quantity of toner being advanced by said developing means to the electrostatic latent image.

15. A printing machine according to claim 14, wherein said developing means includes a donor roller.

16. A printing machine according to claim 15, wherein said charging means includes a blade having the free end region thereof resiliently urged into engagement with said donor roller.

17. A printing machine according to claim 16, wherein said mixing means includes a rotatably mounted elongated member disposed interiorly of the developer unit for fluidizing the toner with the toner being discharged into the developer unit exerting a pressure on the fluidized toner to move the fluidized toner from one end of the developer unit to the other end thereof.

18. A printing machine according to claim 17, wherein said applying means includes a voltage source electrically coupled to said elongated member and said donor roll to apply an electrically bias between said elongated member and said donor roll.

19. A printing machine according to claim 18, wherein said voltage source applies an electrical bias ranging from about 250 volts to about 1000 volts between said elongated member and said donor roll.

20. A printing machine according to claim 19, wherein said voltage source applies an electrical bias preferably of about 600 volts between said elongated member and said donor roll.

* * * * *